US007775858B2

(12) United States Patent
Weber

(10) Patent No.: US 7,775,858 B2
(45) Date of Patent: Aug. 17, 2010

(54) MACHINE FOR DRESSING THE EDGES AND OUTER SURFACES OF FLAT WORKPIECES

(75) Inventor: Georg Weber, Kronach (DE)

(73) Assignee: Hans Weber Maschinenfabrik GmbH, Kronach (DE)

( * ) Notice: Subject to any disclaimer, the term of this patent is extended or adjusted under 35 U.S.C. 154(b) by 0 days.

(21) Appl. No.: 12/117,135

(22) Filed: May 8, 2008

(65) Prior Publication Data

US 2008/0280545 A1 Nov. 13, 2008

(30) Foreign Application Priority Data

May 11, 2007 (DE) ..... 10 2007 022 194

(51) Int. Cl.
*B24B 7/12* (2006.01)

(52) U.S. Cl. ..... 451/261; 451/66; 451/262; 451/271

(58) Field of Classification Search ..... 451/57, 451/58, 65, 66, 178, 182, 184, 194, 211, 451/260, 261, 270, 271, 262, 291
See application file for complete search history.

(56) References Cited

U.S. PATENT DOCUMENTS

| | | | | |
|---|---|---|---|---|
| 1,375,129 A | | 4/1921 | Carrie | |
| 1,430,214 A | * | 9/1922 | Carrie | 451/271 |
| 1,684,029 A | * | 9/1928 | Howard | 451/41 |
| 2,508,276 A | * | 5/1950 | Lecron | 451/41 |
| 2,757,489 A | * | 8/1956 | Touvay et al. | 451/18 |
| 2,948,087 A | * | 8/1960 | Caton | 451/271 |
| 3,822,572 A | * | 7/1974 | Janirek et al. | 69/39 |

FOREIGN PATENT DOCUMENTS

| | | |
|---|---|---|
| CH | 103266 | 2/1924 |

(Continued)

OTHER PUBLICATIONS

Search Report from Dutch Patent Application No. 2001514 dated Feb. 17, 2010 and English translation.

*Primary Examiner*—Timothy V Eley
(74) *Attorney, Agent, or Firm*—McCormick, Paulding & Huber LLP

(57) ABSTRACT

In a machine for processing the edges and outer surfaces of flat workpieces, including a machine frame with a workpiece support surface 12 and at least one dressing head 14 with a work tool carrier, which work tool carrier is rotatably supported on the machine frame for rotation about a first axis perpendicular to the workpiece support surface 12 and is driven by a drive, and which work tool carrier carries at least two work tools 32 rotatably supported eccentrically to the first axis on the work tool carrier each for rotation about a second axis perpendicular to the workpiece support surface 12, and each of which tools is connected with a planet gear 44 which stands in meshing drive engagement with a sun gear 26 coaxial to the first axis so that each circulating work tool carrier defines an effective circle 46 of its work tools 32, with at least two dressing heads 14 being so arranged next to one another that the effective circles 46 of their work tools 32 overlap, with the movement of the work tool carriers of neighboring dressing heads 14 being so controlled that the work tools 42 arranged on their work tool carriers are displaced from one another in the circulating direction.

(Continued)

5 Claims, 2 Drawing Sheets

U.S. PATENT DOCUMENTS

| | | | | |
|---|---|---|---|---|
| 3,874,123 | A * | 4/1975 | Hopkins et al. | 451/271 |
| 5,105,583 | A * | 4/1992 | Hammond et al. | 451/271 |
| 6,986,703 | B2 * | 1/2006 | Weber | 451/285 |
| 7,140,957 | B2 * | 11/2006 | Thysell et al. | 451/350 |
| 7,500,905 | B2 * | 3/2009 | Iga | 451/57 |
| 2004/0058629 | A1 * | 3/2004 | Weber | 451/260 |
| 2007/0010178 | A1 | 1/2007 | von Schumann | |

FOREIGN PATENT DOCUMENTS

| | | | |
|---|---|---|---|
| DE | 103 38 682 | A1 | 4/2004 |
| DE | 202005010997 | U1 | 9/2005 |
| DE | 202007010059 | U1 | 10/2007 |
| EP | 1500467 | A1 | 1/2005 |

* cited by examiner

MACHINE FOR DRESSING THE EDGES AND OUTER SURFACES OF FLAT WORKPIECES

CROSS REFERENCE TO RELATED APPLICATIONS

Applicants hereby claim foreign priority benefits under 35 U.S.C. §119 of German Patent Application No. 10 2007 022 194.2 filed May 11, 2007, the disclosures of which are herein incorporated by reference.

BACKGROUND OF THE INVENTION

The invention concerns a machine for dressing the edges and outer surfaces of flat workpieces, including a machine frame with a workpiece support surface and at least one dressing head with a work tool carrier, which dressing head is supported on the machine frame for rotation about a first axis perpendicular to the workpiece support surface and is driven by means of a drive and carries at least two work tools, each of which work tools is rotatably supported on the work tool carrier for rotation about a second axis eccentric to the first axis and perpendicular to the workpiece support surface and is drivingly connected with a planetary gear in driving engagement with a sun gear fixed to the frame and coaxial with the first axis, so that the rotating work tool carrier defines a circle of influence of the work tool.

A machine of the previously mentioned type is known for example from DE 103 38 682 A1. The overlapping of the rotational movement of the work tool carrier and the compelled rotational movement of the work tool with a higher rotational speed of the work tool in comparison to the rotational speed of the work tool carrier makes possible in this mechanism a high cutting capacity of the work tool and therewith an effective dressing of the workpiece. In the case of the machine known from DE 103 38 682 A1 several disc-shaped grinding or dressing heads are provided which are arranged in two rows perpendicular to the movement direction of the workpieces and following one another in the feed direction of the workpieces, with the two grinding head rows being displaced from one another perpendicularly to the movement direction of the workpieces so that the grinding heads of one row—as seen in the movement direction of the workpieces—close the gaps between the grinding heads of the other row. Accordingly, it is assured that the entire working width of the machine is covered by the grinding work tools, however the machine requires a relatively large amount of space in the advancement direction of the workpieces.

SUMMARY OF THE INVENTION

The invention has as its object the provision of a machine of the previously mentioned kind wherein on the one hand the entire working width of the machine is crossed over by the work tools and which on the other hand—requires little space in the direction of the workpiece advancement.

This object is solved in accordance with the invention with a machine of the previously mentioned kind in that at least two dressing heads are so arranged next to one another that the effective circles of their work tools overlap, with the movement of the work tool carriers of neighboring dressing heads being so controlled that the work tools of one dressing head in their circulating direction are displaced from the work tools of a neighboring processing head in their circulating direction.

In the solution of the invention neighboring dressing heads so intermesh with one another that the dressing paths of the work tools of neighboring dressing heads overlap. Therefore with only a single row of dressing heads lying next to one another the entire working width of the machine can be covered, so that on one hand the workpieces can be inserted at random spots of the working width and on the other hand the mechanism requires only a small amount of space in the transport direction of the workpieces. Preferably the work tool carriers are of beam shape and each carries two work tools, with the work tool carriers of neighboring dressing heads being displaced 90° from one another.

The machine is suited especially for the dressing of the edges of workpieces; especially for the dressing of cut out flat steel pieces with the aid of work tools known in themselves, which work tools for example are made of cylindrical grinding bodies each of which includes a plurality of grinding blades arranged in radial planes containing the cylinder or rotational axis of the work tool. Basically in keeping with the invention however other work tools can also be used, as for example brushes, which are then independent of rotation direction.

Given the spacing of the work tool axes on the work tool carrier and given the diameter of the work tools, the minimum spacing of neighboring dressing heads can be easily determined. An especially compact arrangement is possible if the work tool carriers of two neighboring dressing heads are driven in opposite rotational directions. In this case it is important that the rotation direction of the work tools of neighboring work tool carriers is always the same. That means, that the rotation directions of the work tools of the one dressing head are the same as the rotation of their associated work tool carrier, while the rotation directions of the work tools of the other dressing head is opposite to the rotation direction of its associated work tool carrier.

BRIEF DESCRIPTION OF THE DRAWINGS

The following description explains the invention by way of an exemplary embodiment in association with the accompanying drawings. The drawings are.

DETAILED DESCRIPTION OF THE PREFERRED EMBODIMENTS

Figure 2:
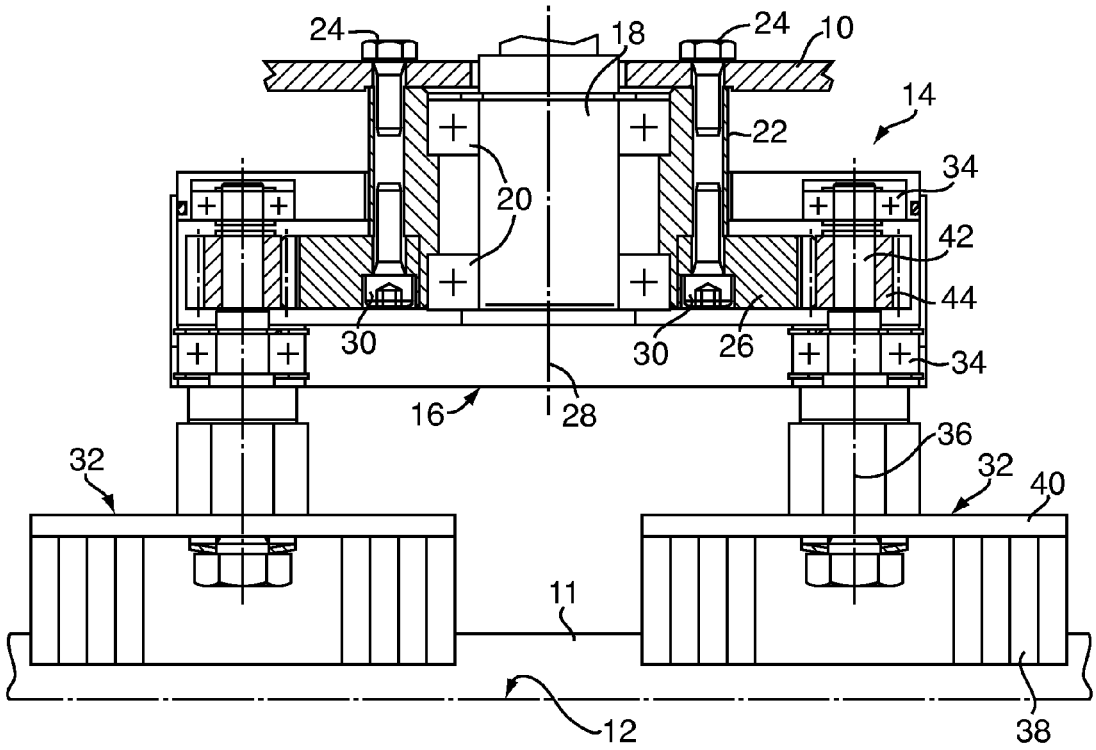
FIG. 2 is a cross-sectional view through a first dressing head and containing the axis of a work tool carrier.
Figure 3:
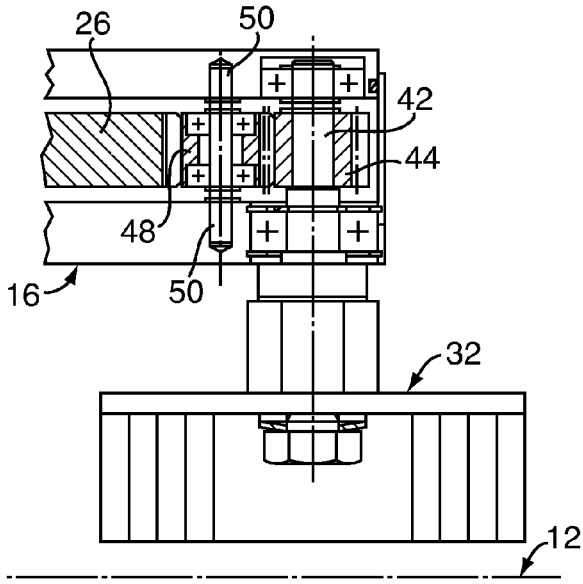
FIG. 3 is a partial sectional view corresponding to FIG. 2 but taken through a second dressing head.

In FIG. 2 indicated at 10 is a carrier beam of a not otherwise illustrated machine frame of a grinding machine whose workpiece support surface for a workpiece 11 is indicated by a dashed-dotted line 12. On the carrier beam 10 is arranged a dressing head indicated generally at 14. This head includes a work tool carrier 16 which by means of a shaft 18 is rotatably supported by bearings 20 in a bearing bushing 22 fastened to the carrier beam by screws 24. The bearing bushing 22 carries at its end facing the work tool carrier 16 a sun gear 26 which is held coaxial to the axis 28 of the shaft 18 by the help of screws 30 threaded into the bearing bushing 22.

On the work tool carrier in radial spacing from the axis 28 are two cylindrical work tools 32 each supported for rotation about an axis 36 by bearings 34, which axis 36 like the axis 28 of the shaft 18 is directed perpendicularly to the workpiece support surface 12. The work tools in the illustrated example are cylindrical grinding bodies each having a plurality of grinding blades 38 (FIG. 1) which are arranged in radial planes containing the axis 36 of the work tool 32 and which are fastened to a support plate 40 of the work tool 32. The spacing of the work tool 32 from the workpiece support surface 12 is so adjusted that it is smaller than the thickness of a workpiece 11 measured perpendicularly to the workpiece support surface 12. With the passage of a workpiece 11 through the dressing machine the work tools 32 encountered the edge surfaces of the workpiece 11 with the grinding blades or bristles of the work tools 32 becoming deflected and being drawn over the edges and the outer surface of the workpiece 11.

In respect to each work tool 32 the shaft journal 42 fastened to the support plate 40, and by which the work tool is rotatably supported in the work tool carrier 16, carries rotationally fixed to it a pinion 44 which meshes with the sun gear 26. Rotation of the work tool carrier 16 about the axis 28 therefore causes the work tools 32 to be rotated about their axes 36 by the rolling of the pinions or planet gears 44 on the sun gear 26 fixed to the machine frame. The drive of the work tool carrier 16 about the axis 28 is accomplished with the help of a non-illustrated customary drive, for example electromotively.

Figure 1:
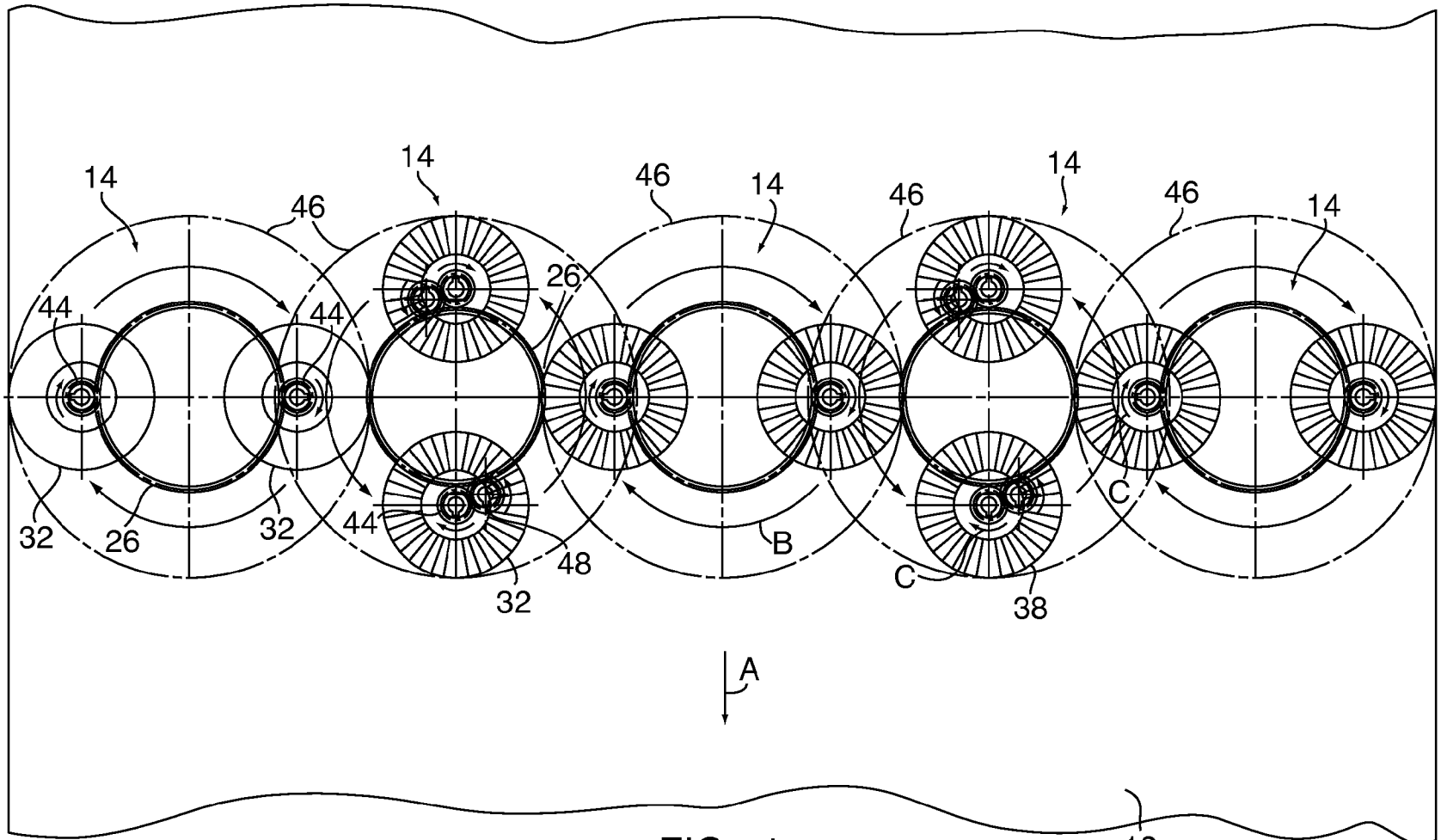
FIG. 1 is a schematic plan view onto a row of dressing heads which row stretches perpendicularly to the feed direction of the workpieces over the width of a workpiece support surface.

In FIG. 1 is seen a row of dressing heads 14 which extend perpendicularly over the workpiece support surface 12 of the machine, with the feed direction of the workpieces being given by the arrow A. The spacing of the rotation axes 28 of the work tool carriers 16 of neighboring dressing heads 14 is so chosen that the effective circular paths 46 of the work tools 32 of neighboring dressing heads 14 overlap. To make certain that the work tools 32 of neighboring dressing heads 14 do not interfere with one another the work tool carriers 16 of neighboring dressing heads are displaced 90° from one another, as is shown in FIG. 1. To assure that this displacement of the work tools of neighboring dressing heads is exactly maintained even under load, the work tool carriers are advantageously driven by non-illustrated gears from one common drive motor. Basically the drive of the work tool carrier 16 of the dressing heads 14 can be so chosen that all work tool carrier 16 are rotated in the same direction. Preferably, however, pairs of neighboring work tool carriers 16 are driven in opposite directions as is shown in FIG. 1 by the arrows B, since in this way the axial spacing of neighboring dressing heads 14 can be reduced.

In the case of the illustrated embodiment of the invention all work tools of the dressing heads 14 rotate in the same direction as is indicated by the arrows C. This is important in the case of work tools such as those described above which produce a grinding effect. That means that the work tools 32 in the one dressing head rotate in the direction opposite to the rotation direction of their work tool carrier 16, while in the other neighboring dressing head the work tools 32 rotate in the same direction as their work tool carrier.

In the dressing head illustrated in FIG. 2 the rotation direction of the work tools 32 is opposite to the circulating direction of the work tool carrier 16. One such dressing head in FIG. 2 is shown at positions 1, 3 and 5 in the illustrated row of dressing heads. On the other hand in the dressing heads at positions 2 and 4 contrary to this the drive of the work tools 32 does not take place directly by the meshing of the planet gears 44 with the sun gear 26, and instead the drive occurs through an intermediate gear 48 which is supported on the work tool carrier 16 by a shaft 50 for free rotation while meshing on one hand with the sun gear 26 and on the other hand with the planet gears 44.

The presented arrangement shows that with the solution of the invention a very compact arrangement of grinding tools can be realized. The path of the grinding work tools so overlap that the entire working width of the workpiece support surface is crossed over by the circulating and in themselves rotating work tools. Therefore workpieces can be fed onto the workpiece support surface 12 at random positions relative to the machine for dressing. At the same time the dressing machine requires only a small amount of space in the feed direction of the workpieces.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A machine for dressing the edges and outer surfaces of flat workpieces including a machine frame with a workpiece support surface and at least two dressing heads each with a respective work tool carrier which is rotatably supported on the machine frame for rotation about a respective first axis perpendicular to the workpiece support surface, and each work tool carrier is drivable by a drive and carries at least two work tools which are rotatably supported on each respective work tool carrier eccentrically to each respective first axis for rotation about second axes perpendicular to the workpiece support surface and each respective work tool drivingly connects with a respective planet gear which drivingly meshes with a sun gear fixed to the frame coaxial to each respective first axis, so that when rotating each work tool carrier defines a working circle of the at least two work tools, wherein at least two dressing heads are so arranged substantially laterally next to one another that the working circles of the respective work tools overlap one another, with the rotation of each respective work tool carrier of neighboring dressing heads being so controlled that the at least two work tools arranged on each respective work tool carrier of the neighboring dressing heads is displaced from one another in the circumferential direction about each respective first axis, wherein each work tool carrier is beam-shaped and carries the at least two work tools, and each respective work tool carrier of the neighboring dressing heads is displaced by 90° with respect to one another, and wherein each respective work tool carrier of the neighboring dressing heads is driven in opposite directions of rotation.

2. The machine according to claim 1, wherein the work tools are formed as essentially cylindrical grinding bodies, each of the grinding bodies includes a plurality of grinding blades which blades are arranged in radial planes containing the axis of the grinding body.

3. The machine according to claim 1, wherein the rotations of the work tools are each in the same rotation direction as that of their associated work tool carrier.

4. The machine according to claim 1, wherein the rotations of the work tools are each in the opposite rotation direction to that of their associated work tool carrier.

5. The machine according to claim 1, wherein the rotation directions of the work tools of all work tool carriers are the same.

* * * * *